US006779471B2

(12) United States Patent
Resta

(10) Patent No.: US 6,779,471 B2
(45) Date of Patent: Aug. 24, 2004

(54) APPARATUS FOR FINISHING PIECES CUT FROM A LENGTH OF TEXTILE MATERIAL, PARTICULARLY FOR CLOSING THE LEADING EDGE OF A TUBULAR PIECE

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 189 days.

(21) Appl. No.: 09/996,988

(22) Filed: Nov. 30, 2001

(65) Prior Publication Data

US 2002/0069803 A1 Jun. 13, 2002

(30) Foreign Application Priority Data

Dec. 7, 2000 (IT) ..... BO2000A0716

(51) Int. Cl.[7] ..... D05B 27/10
(52) U.S. Cl. ..... 112/470.12
(58) Field of Search ..... 271/3.14; 226/24, 226/115, 196.1; 112/470.12, 122, 122.3, 305, 306, 307, 318; 83/202, 208, 471, 477

(56) References Cited

U.S. PATENT DOCUMENTS 4,287,841 A * 9/1981 Rovin ..... 112/470.03
4,491,079 A * 1/1985 Gustavsson ..... 112/470.16
4,700,642 A 10/1987 Hankinson, Jr.
4,856,439 A * 8/1989 O'Neal et al. ..... 112/10
5,529,005 A * 6/1996 Saotome et al. ..... 112/470.31
5,913,277 A * 6/1999 Resta ..... 112/470.12

FOREIGN PATENT DOCUMENTS

IT 1 183 122 10/1987

* cited by examiner

*Primary Examiner*—Ismael Izaguirre
(74) *Attorney, Agent, or Firm*—Guido Modiano; Albert Josif; Daniel O'Byrne

(57) ABSTRACT

An apparatus for sewing finishing a piece cut from a length of textile material unwound from a roll and closing the leading edge thereof, comprising: advancement rollers for advancement of the length of textile material, to unwind two successive portions of the length of material, for a total longitudinal extension equal to the longitudinal extension of the piece; a cutting blade suitable to cut a piece from the length of textile material with a cut that is perpendicular to the unwinding direction and forms the rear edge of the cut piece and the leading edge of the length of textile material to be unwound; and positioning elements for arranging the leading edge of the unwound length of material with respect to a sewing machine.

13 Claims, 5 Drawing Sheets

APPARATUS FOR FINISHING PIECES CUT FROM A LENGTH OF TEXTILE MATERIAL, PARTICULARLY FOR CLOSING THE LEADING EDGE OF A TUBULAR PIECE

BACKGROUND OF THE INVENTION

The present invention relates to an apparatus for finishing pieces cut from a length of textile material unwound from a roll by sewing their leading edge, particularly for closing the leading edge of a tubular piece.

Hereinafter, for the sake of convenience of presentation, the term "length" is understood to designate woven or non-woven textile articles of different kinds, composed of one or more layers, even tubular and mutually different as for quality and consistency, while the term "piece" is understood to designate a portion cut from said length of textile material.

In the preparation of pieces of textile material, particularly padded pieces as used for example to cover mattresses or to prepare quilts, the need is felt to finish the leading edge in order to keep the various layers of the piece properly superimposed one another and avoid staggering of the edges, so that the piece can be positioned easily for the subsequent processes.

This need is felt even more when the pieces are cut from a length of textile material composed of multiple layers and unwound from a roll, or when the length of textile material is prepared by joining multiple layers unwound from respective rolls.

Tubular pieces are also known which are used to cover, for protective purposes, blocks of rubber latex, for example in the manufacture of mattresses.

Such tubular pieces, once cut to size from the unwound length of textile material, must be closed at one end so as to form a pouch for containing the latex block.

SUMMARY OF THE INVENTION

The aim of the present invention is therefore to provide an apparatus that is suitable to be inserted in a line for producing pieces of textile material, particularly tubular pieces, and allows to meet this requirement.

Within this aim, an object of the present invention is to provide an apparatus that is relatively simple to manufacture and therefore economically advantageous.

This aim and this and other objects which will become better apparent hereinafter, are achieved with an apparatus for finishing a piece cut from a length of textile material unwound from a roll by sewing its leading edge, particularly for closing the leading edge of a tubular piece, characterized in that it comprises: means for causing the advancement of said length of textile material, suitable to unwind two successive portions of the length of material, for a total longitudinal extension equal to the longitudinal extension of said piece; cutting means, arranged downstream of said advancement means and suitable to cut a piece from said length of textile material with a cut that is perpendicular to said unwinding direction and forms the rear edge of the cut piece and the leading edge of the length of textile material to be unwound; positioning means, arranged downstream of said cutting means and suitable to arrange the leading edge of said unwound length of material with respect to a sewing machine; said advancement, cutting and positioning means being coordinately operatable so that: in a first step, said advancement means unwinds said length of material for a said first portion whose longitudinal dimension is such that said leading edge is engaged in said positioning means; in a second step, said positioning means is actuated so as to position said leading edge in alignment with the sewing path of said sewing machine; in a third step, said sewing machine is actuated so as to produce a stitched seam along said leading edge; in a fourth step, said advancement means unwinds a said second portion from said length of material; and in a fifth step, said cutting means cuts a piece from said length of material.

BRIEF DESCRIPTION OF THE DRAWINGS

Further characteristics and advantages of the present invention will become better apparent from the following description of a preferred embodiment thereof, illustrated only by way of non-limitative example in the accompanying drawings, wherein.

DESCRIPTION OF THE PREFERRED EMBODIMENTS

Figures 1, 8:
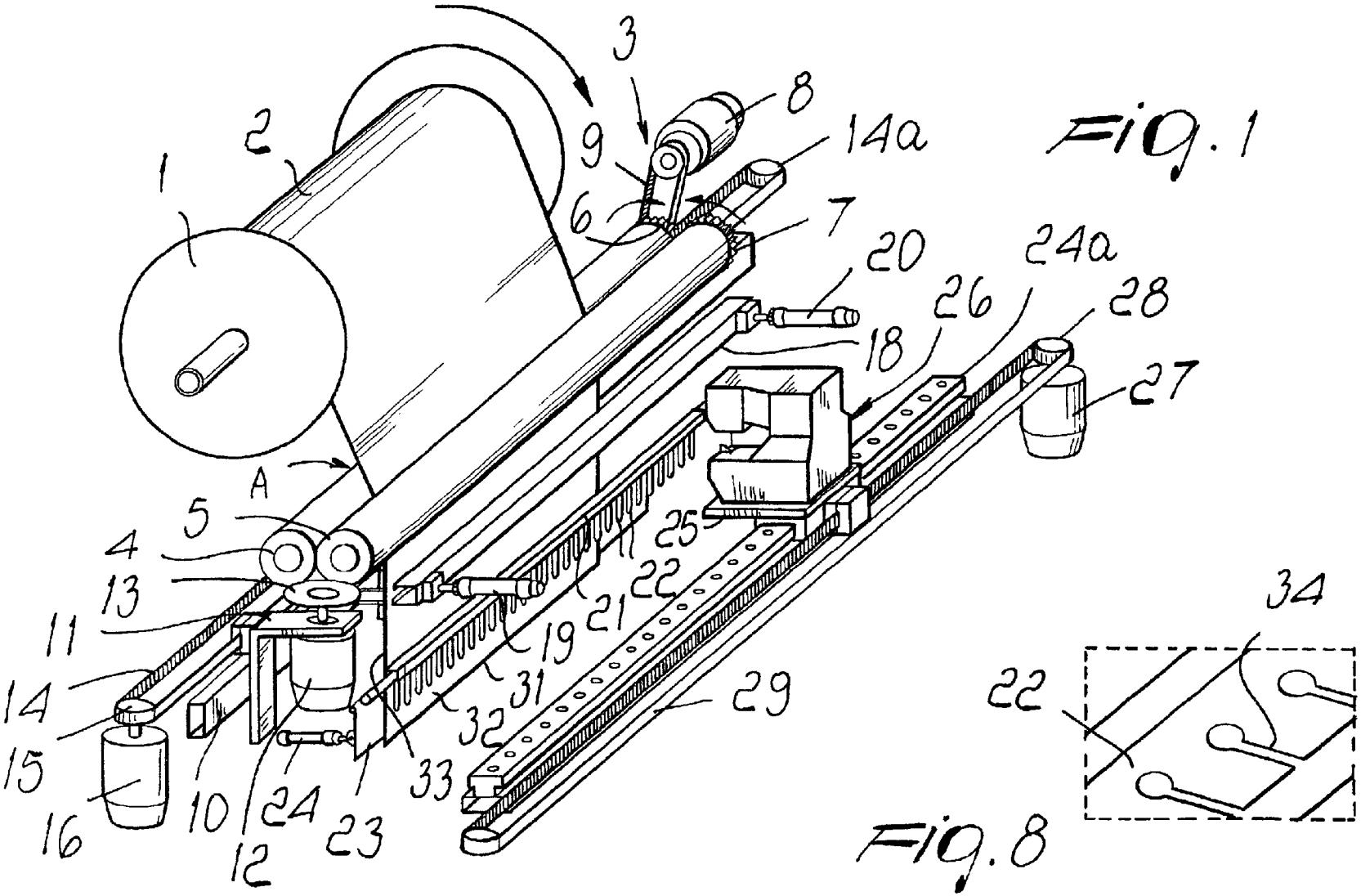
FIG. 1 is a partially schematic perspective view of the apparatus.
FIG. 8 is a view of a second embodiment of the apparatus.

Specifically with reference to FIG. 1, the apparatus comprises means (not shown) for rotatably supporting a roll 1 on which a length of textile material 2, from which the pieces to be finished will be obtained, is wound. The length of material 2 is constituted for example by a tubular article for wrapping latex mattresses, or by a plurality of superimposed layers. In this last case, the length of material, instead of being pre-manufactured and wound on a single roll, can be produced by conveying and coupling at the inlet of the apparatus individual layers unwound from a corresponding number of rolls.

The length of material 2 is unwound from the roll 1 in the direction A by means of an advancement assembly generally designated by the reference numeral 3. Said assembly 3 is composed of two parallel grip rollers 4 and 5, between which the length of material is guided from above. The rollers 4 and 5 are perpendicular to the direction A and have, at one end, respective gears 6 and 7 that mesh with each other and are actuated so as to rotate in opposite directions by means of an electric motor 8 and a transmission composed of a belt 9 wound on a pair of pulleys that are keyed respectively to the output shaft of the electric motor 8 and on the roller 4 adjacent to the gear 6.

Below the grip and unwinding assembly 3 and at the rear of the length of textile material 2, a rail 10 is provided, which is parallel to the rollers 4 and 5 and acts as a sliding guide for a carriage 11 that comprises a bracket on which an electric motor 12 is supported, said motor having a shaft with a vertical axis that protrudes upward. A disk-like blade 13 is keyed to the shaft 12 and intersects the plane of the length of material 2 below the rollers 4 and 5.

The carriage 11 is rigidly coupled to a portion of a transmission belt 14 that is parallel to the rail 10. The belt 14 is wound in a closed loop around a driven pulley 14*a* and around a driving pulley 15 actuated by an electric motor 16.

At the rear of the length of material 2, i.e., on the side engaged by the roller 4, and below the grip and unwinding unit 3, there is an abutment bar that is parallel to the roller 4 and is composed of two L-shaped profiled elements 17*a* and 17*b*, between which there remains a gap 17*c* along which the blade 13 can slide. Opposite the abutment bar 17*a* and 17*b*, but on the opposite side of the length of material 2, there is a locking bar 18, constituted by a profiled element that has a C-shaped cross-section with two superimposed longitudinal wings 18*a* and 18*b* that delimit a longitudinal gap 18*c* that is directed toward the length of material 2 and faces the gap 17*c*. The profiled element 18 is supported, at the level of the circular blade 13, by two pneumatic actuators 19 and 20, which are suitable to move it between a position that is spaced from the length of material 2 and a position for locking the length of material 2 between the profiled elements 17*a* and 17*b* and the wings 18*a* and 18*b* in order to allow the blade 13 to slide in the gaps 17*c* and 18*c* during the cutting of the end portion of the piece 2 that will constitute the piece to be finished.

Below the bar 10 and parallel thereto there is an abutment bar 21 to which a plurality of equidistant elastic tabs 22 are fixed. The tabs 22 are substantially perpendicular to the plane of the length of material 2 and protrude so as to form a sort of comb.

Proximate to the bar 21, but at the rear of the length of textile material 2, a strip 23 is articulated which is actuated by pneumatic actuators 24 capable of imparting to the strip an oscillation of 90° between a vertical position and a horizontal position. In the vertical position, the strip 23 is flush with the length of material 2, while in the horizontal position the strip 23 arranges itself below the tabs 22 and so that its free edge coincides with the ends of the tabs.

In front of the abutment bar 21 and parallel thereto there is a rail 24*a* that acts as a guide for a slider 25. The slider 25 supports a sewing machine 26 whose working plane is co-planar to the plane formed by the tabs 22.

The slider 25 is actuated with a reciprocating motion along the rail 24*a* so that the sewing machine 26 can be moved from one end to the other of the abutment bar 21. For the actuation of the slider 25 along the rail there is an electric motor 27 provided with a vertical output shaft on which a driving pulley 28 is keyed. A belt 29 is wound around the driving pulley 28 and is closed in a loop around a driven pulley 30. The portion of the belt 29 is parallel to the rail 24*a* and the slider 25 is fixed thereto in a manner similar to the fixing of the carriage 11 to the belt 14.

Figure 2:
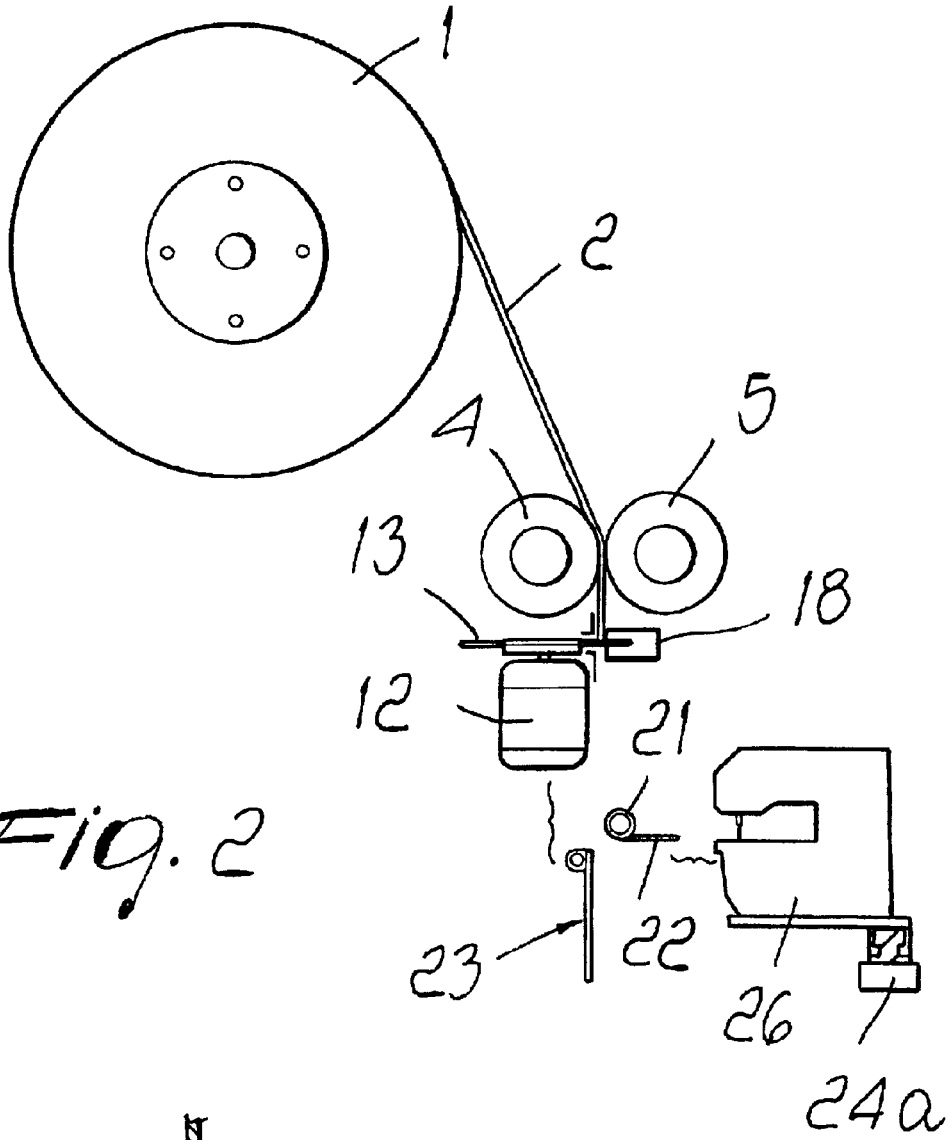
FIG. 2 is an axial schematic view of the apparatus of FIG. 1 in the initial condition of the operating cycle.
Figure 3:
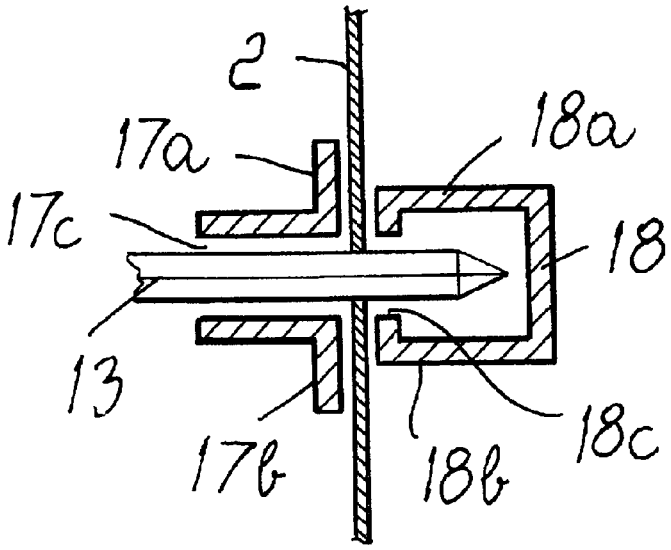
FIG. 3 is an enlarged-scale view of a detail of FIG. 2.

The operation of the apparatus is described hereinafter assuming that the apparatus is in the position assumed at the end of an operating cycle shown in FIG. 2. In this position, the locking bar 18 is kept spaced from the length of textile material 2, which by being fed by the grip unit formed by rollers 4 and 5 can slide between the profiled elements 17*a* and 17*b* and the bar 18. The strip 23 is turned vertically downward and the sewing machine 26 is in stand by at one end of the rail 24.

Figure 4:
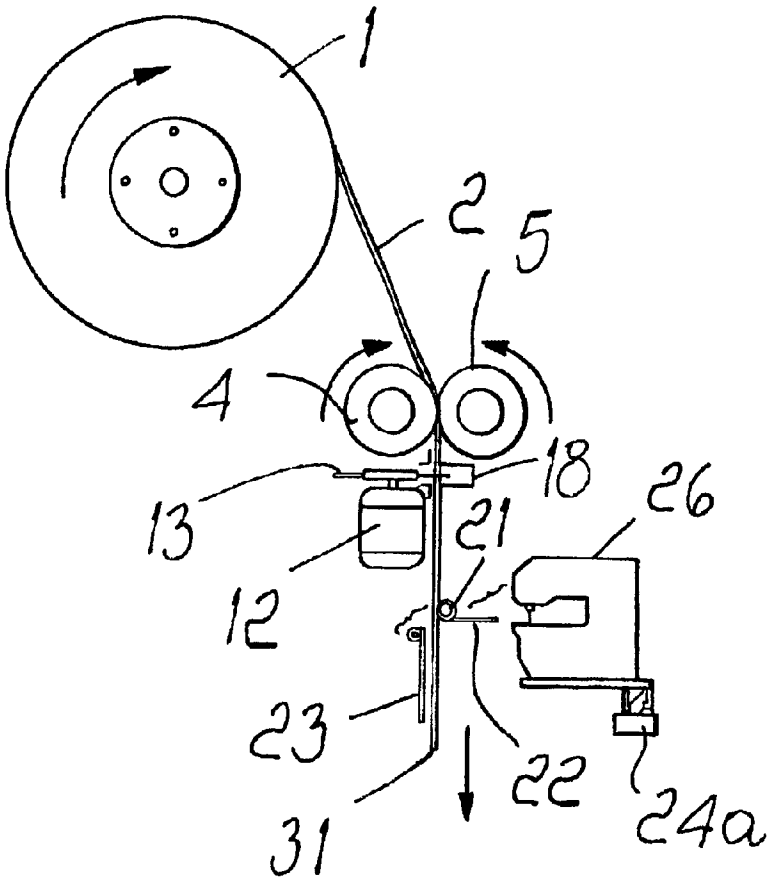

While the initial end of the length of textile material 2 is gripped between the rollers 4 and 5, the motor 8 is activated (see FIG. 4) and, by actuating the rollers 4 and 5 so that they rotate in opposite directions, causes the unwinding of the length of material 2 by a preset extent. The portion of the length of material 2 which, due to the traction produced by the rollers 4 and 5, is unwound from the roll 1, after passing between the profiled elements 17*a* and 17*b* and the abutment bar 18, arranges itself between the strip 23 and the bar 21. The portion of the length of material 2 that is unwound in each instance from the roll 1 has such a longitudinal dimension that its leading edge 31 protrudes slightly below the edge of the strip 23.

Figure 5:
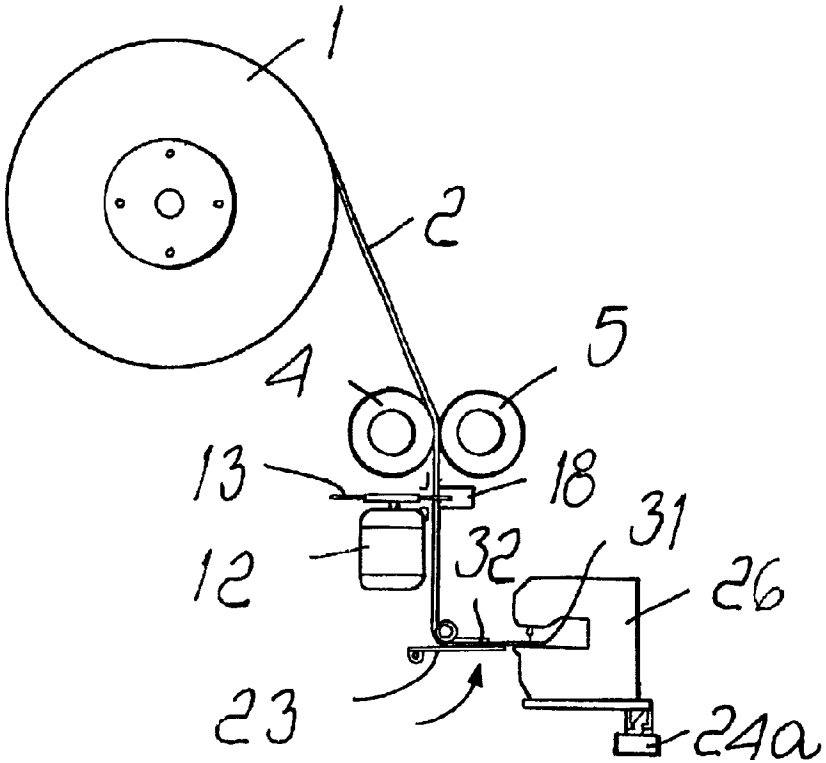
FIGS. 4, 5, 6 and 7 are schematic views of the apparatus of FIG. 1 in four successive operating situations.

At this point, the cylinders 24 are activated, turning the strip 23 horizontally below the tabs 22 (see FIG. 5) so as to block the front transverse margin 32 of the length of material 2 so that its leading edge 31, by protruding forward from the tabs 22 and from the strip 23, is now positioned on the line of advancement of the needle of the sewing machine 26.

Figure 6:
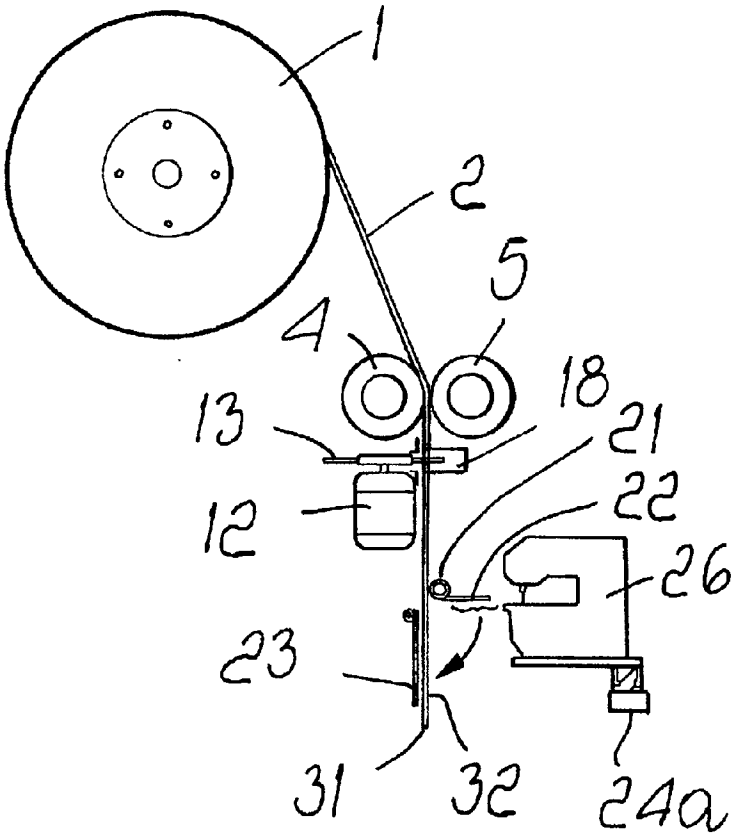
Figure 9:
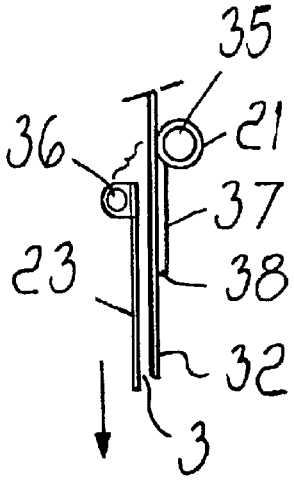
FIGS. 9, 10, 11, 12, and 13 are schematic views of a third embodiment in five operating situations.
Figure 10:
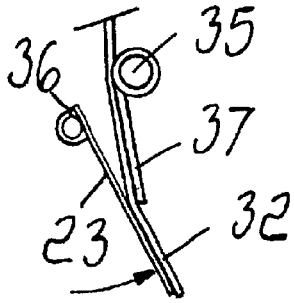
Figure 11:
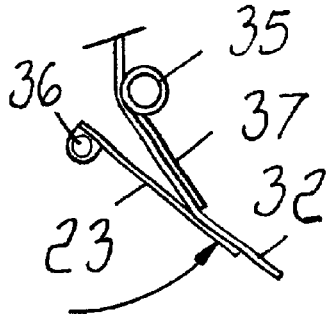
Figure 12:
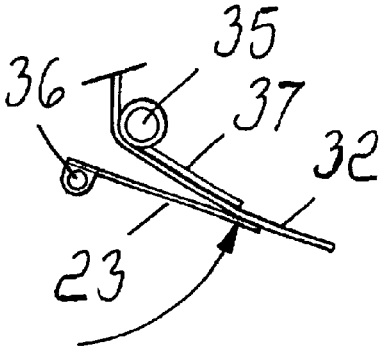
Figure 13:
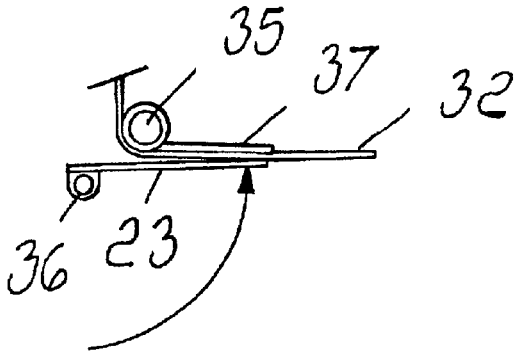

By activating the motor 27, the sewing machine 26 is made to advance along the rail 24*a* so as to sew the leading edge 31. Once sewing has been completed, the cylinders 24 are actuated, returning the strip 23 to the vertical position (see FIG. 6).

Figure 7:
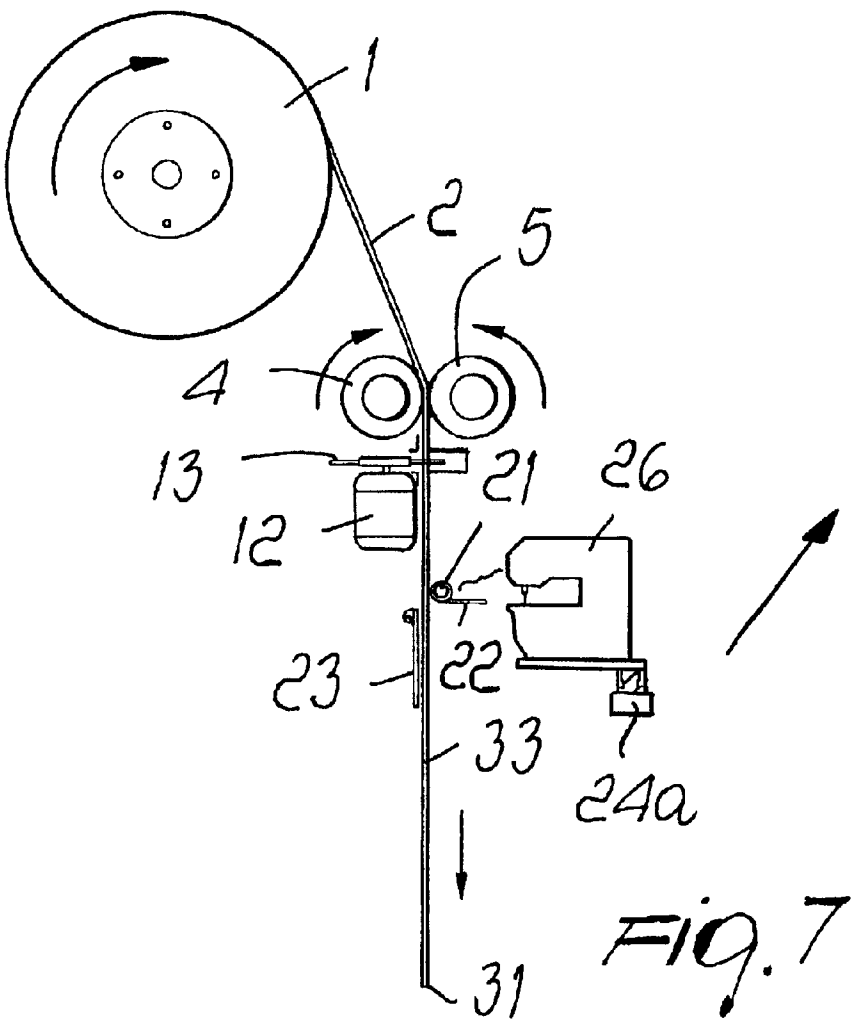

In the subsequent step (see FIG. 7), the rollers 4 and 5 of the assembly 3 are activated again, unwinding from the roll 1 a portion of the length of material whose longitudinal dimension corresponds to the longitudinal dimension of the piece 33 to be obtained.

Then the pneumatic cylinders 19 and 20 are activated, causing the advancement of the bar 18 until the edges of the wings 18*a* and 18*b* that delimit the gap 18*c* abut against the profiled elements 17*a* and 17*b*, thus locking the length of textile material 2. Once the length of material 2 has been clamped, the electric motor 16 is activated and causes the advancement of the carriage 11 and therefore of the cutting assembly mounted thereon. In this manner, the rotating blade 13, by advancing along the gaps 17*c* and 18*c* transversely to the unwinding direction A, cuts from the length of textile material 2 a piece 33 whose longitudinal dimension is equal to the longitudinal dimension between the edge 31 and the gap 18.

The operating cycle is then repeated in the manner described above.

It is evident that the described apparatus allows to work on individual pieces obtained from a continuous length of textile material wound on a roll. This ensures that the various layers that compose the piece, once the cutting of the length of material has been completed, cannot arrange themselves out of place during the handling to which they are subjected in order to be prepared for successive treatments such as bordering, quilting and so forth. If the tubular part is constituted by a tubular article, the stitched seam closes the leading edge and forms a pouch that can be used to cover mattresses or the like.

In the practical embodiment of the invention, numerous modifications and variations are possible all within the scope of the same inventive concept.

In a second embodiment of the invention, the tabs 22 for elastic retention of the margin 23 of the length of textile material are obtained by cutting notches 34 into a metal plate as shown in FIG. 8.

In a third embodiment of the invention (see FIGS. 9–13), the bar 21 is articulated about an axis 35 located at a higher level than the axis 36 of the strip 23. A metal plate 37 is rigidly coupled to the bar 21, instead of the tabs 22, and in the inactive position arranges itself by gravity parallel to the strip 23 at a distance that is greater than the thickness of the length of textile material 2. The height of the metal plate 37 is such that its free edge 38 is arranged at an intermediate level of the strip 23.

By way of the distance between the walls of the metal plate 37 and of the strip 23, when said strip is turned so as to tilt horizontally the margin 32, said margin is locked by the edge 38 against the strip 23. As the rotation of the strip 23 continues, the axial offset of the axes 35 and 36 causes a sliding of the edge 38 on the strip 23 and the gradual expulsion of the margins 32 beyond the edge of the strip 23.

Once the strip 23 has reached the horizontal position, the edge 31 of the margin 32 is aligned with the sewing path of the sewing machine 26.

The disclosures in Italian Patent Application No. BO2000A000716 from which this application claims priority are incorporated herein by reference.

What is claimed is:

1. An apparatus for sewing finishing a piece out from a length of textile material unwound from a roll and closing a leading edge of the length of textile material, comprising: advancement means for causing advancement of said length of textile material to unwind along an unwinding direction two successive portions of said length of textile material, for a total longitudinal extension equal to the longitudinal extension of the piece to be finished; cutting means, arranged downstream of said advancement means to cut said piece from said length of textile material with a cut that is perpendicular to said unwinding direction and forms a rear edge of the cut piece and the leading edge of the length of textile material to be unwound; positioning means, arranged downstream of said cutting means; and a sewing machine having a sewing path arranged at said positioning means, said positioning means being adapted to oscillate through a 90° angle for arranging and block the leading edge of said unwound length of material at said sewing path of said sewing machine; and said advancement means, said cutting means and said positioning means being coordinately operatable so that said advancement means unwind said length of material for a said first portion whose longitudinal dimension is such that said leading edge is engaged in said positioning means, said positioning means oscillate through said 90° angle to position said leading edge in alignment with and at the sewing path of said sewing machine, said sewing machine produces a stitched seam along said leading edge, said advancement means unwind a said second portion from said length of material, and said cutting means cut a piece from said length of material.

2. The apparatus of claim 1, wherein said cutting means comprise: a guide that lies transversely to the unwinding direction of said length of textile material; a carriage that can move with a reciprocating motion on said guide; and an assembly, composed of a cutting blade and of a motor for actuating the blade, mounted on said carriage.

3. The apparatus of claim 2, comprising: guides; and motorization assemblies, said cutting assembly and said sewing machine being slidingly mounted and connected on respective ones of said guides and being actuated with a reciprocating motion by respective ones of said motorization assemblies, each said respective motorization assembly comprising a driving pulley, a belt wound around said driving pulley and a pulley which is guided so as to have a portion thereof that is parallel to said guides to which said cutting assembly and said sewing machine are connected.

4. The apparatus of claim 2, comprising an abutment bar; a locking bar that lies opposite said abutment bar; actuation means for actuating said locking bar between a position that is spaced from said abutment bar in order to allow the passage of said length of textile material and a position for resting against said abutment bar in order to allow locking of said length of textile material, said abutment and locking bars being provided with mutually opposite gaps which provide passage for said blade for cutting said piece from said length of textile material.

5. The apparatus of claim 4, wherein said actuation means for actuating said strip and said locking bar are pneumatic actuators.

6. The apparatus of claim 4, wherein said positioning means comprise: a bar with a plurality of elastic tabs fixed thereon in a comb-like manner; a strip articulated about an axis that lies transversely to the unwinding direction of the length of textile material; a strip actuation means for actuating said strip to move between a vertical position, which allows passage of said length of textile material between said strip and said bar, and a horizontal position, at which said strip locks a front margin of said length of textile material under said elastic tabs so that the leading edge of said piece protrudes from said tabs and said strip.

7. The apparatus of claim 6, wherein said elastic tabs are formed by a blanked metal plate.

8. The apparatus of claim 4, wherein said positioning means comprise: a strip; a metal plate; said strip and metal plate being articulated about axes that lie transversely to the unwinding direction in which said length of textile material unwinds; strip actuation means for actuating said strip to move between a position in which the strip forms, together with said metal plate, a passage channel for said length of material, and a position in which clamps said length of material against an edge of said metal plate, said strip and said metal plate being arranged so as to perform a relative movement whereby to push a margin of said length of textile material onto the sewing path of said sewing machine.

9. The apparatus of claim 8, wherein said locking bar is constituted by a profiled element that has a C-shaped cross-section open toward said length of textile material, and said abutment bar is constituted by two parallel and spaced profiled elements, said C-shaped cross-section and said profiled elements forming respective mutually opposite gaps which allow, in a mutual resting position, passage of said blade.

10. The apparatus of claim 9, wherein said advancement means comprise a motor element, and a grip assembly constituted by a pair of parallel and contrarotating rollers between which said length of textile material is guided.

11. The apparatus according to claim 10, wherein said rollers are provided with respective gears that mesh with each other, one of said rollers being actuated by said motor element.

12. An apparatus for sewing finishing a piece cut from a length of textile material unwound from a roil and closing a leading edge of the length of textile material, comprising: advancement means for causing advancement of said length of textile material to unwind along an unwinding direction two successive portions of said length of textile material, for a total longitudinal extension equal to the longitudinal extension of the piece to be finished; cutting means, arranged downstream of said advancement means to cut said piece from said length of textile material with a cut that is perpendicular to said unwinding direction and forms a rear edge of the cut piece and the leading edge of the length of textile material to be unwound; positioning means, arranged downstream of said cutting means; and a sewing machine having a sewing path arranged at said positioning means, said positioning means comprising a strip that is oscillatable through a 90° angle between a position arranged flush with said unwinding direction of the length of textile material and a position for blocking the leading edge of said unwound length of material at said sewing path of said sewing machine; and said advancement means, said cutting means and said positioning means being coordinately operatable so that said advancement means unwind said length of material for a said first portion whose longitudinal dimension is such that said leading edge is engaged in said positioning means, said positioning means oscillate through said 90° angle to position said leading edge in alignment with and at the sewing path of said sewing machine, said sewing machine produces a stitched seam along said leading edge, said advancement means unwind a said second portion from said length of material, and said cutting means cut a piece from said length of material.

13. An apparatus for sewing finishing a piece out from a length of textile material unwound from a roll and closing a leading edge of the length of textile material, comprising: advancement means for causing advancement of said length of textile material to unwind along an unwinding direction two successive portions of said length of textile material, for a total longitudinal extension equal to the longitudinal extension of the piece to be finished; cutting means, arranged downstream of said advancement means to cut said piece from said length of textile material with a cut that is perpendicular to said unwinding direction and forms a rear edge of the cut piece and the leading edge of the length of textile material to be unwound; positioning means, arranged downstream of said cutting means; and a sewing machine having a sewing path arranged at said positioning means, said positioning means being provided oscillatable through a 90° angle between a vertical position in which the positioning means are arranged flush with said unwinding direction of the length of textile material and a horizontal position for blocking the leading edge of said unwound length of material at said sewing path of said sewing machine; and said advancement means, said cutting means and said positioning means being coordinately operatable so that said advancement means unwind said length of material for a said first portion whose longitudinal dimension is such that said leading edge is engaged in said positioning means, said positioning means oscillate through said 90° angle to position and block said leading edge in alignment with and at the sewing path of said sewing machine, said sewing machine produces a stitched seam along said leading edge, said advancement means unwind a said second portion from said length of material, and said cutting means cut a piece from said length of material.

* * * * *